United States Patent [19]

Murray et al.

[11] Patent Number: 4,685,971

[45] Date of Patent: Aug. 11, 1987

[54] OZONE OXIDATION OF DEPOSITS IN COOLING SYSTEMS OF NUCLEAR REACTORS

[75] Inventors: Alexander P. Murray, Murrysville; Lawrence F. Becker, Jr., North Huntingdon; Clifton G. Slater, Wilkinsburg; Michael C. Skriba, Plum Borough, all of Pa.

[73] Assignee: Westinghouse Electric Corp., Pittsburgh, Pa.

[21] Appl. No.: 655,319

[22] Filed: Sep. 27, 1984

Related U.S. Application Data

[63] Continuation of Ser. No. 513,134, Jul. 12, 1983, abandoned.

[51] Int. Cl.[4] ..... G23G 1/00; G21F 9/00

[52] U.S. Cl. ..... 134/2; 134/3; 134/41; 252/404; 252/626

[58] Field of Search ..... 134/2, 3, 13, 28, 41; 252/404, 626; SN5/13, 134

[56] References Cited

PUBLICATIONS

Leich, "Oxidation of Cerium (III) by Ozone and by Electrolysis", BNWL-805, Battelle Memorial Institute, 1968.

*Primary Examiner*—Arthur L. Corbin

*Attorney, Agent, or Firm*—R. D. Fuerle

[57] ABSTRACT

Disclosed is an improved process for oxidizing chromium in deposits in the cooling system of a nuclear reactor using a solution of ozone. The improvement consists of adding to the solution about 0.01 to about 0.5% of a water-soluble cerium IV compound, about 0.1 to about 0.5% of a water-soluble aromatic compound having at least one ketone group on an aromatic ring, or adding both. Also disclosed is the composition of water, ozone, the cerium IV compound and the aromatic compound. Also disclosed is a process for decontaminating the cooling system of nuclear reactors by adding a decontamination composition to the coolant, circulating the coolant between the cooling system and a cation exchange resin, removing the decontamination composition by passing it through an anion exchange resin, adjusting the temperature to 40° to about 100° C., adding the ozone oxidation composition, circulating the coolant through the cooling system, raising the temperature to at least about 100° C., passing the coolant through an anion exchange resin or a mixed resin, adjusting the temperature to about 60° to 100° C. and repeating the addition of the decontamination composition and its removal.

12 Claims, No Drawings

OZONE OXIDATION OF DEPOSITS IN COOLING SYSTEMS OF NUCLEAR REACTORS

This application is a continuation, of application Ser. No. 513,134, filed July 12, 1983, now abandoned.

CROSS-REFERENCE TO RELATED APPLICATIONS

This application is related to application Ser. No. 501,980, filed June 7, 1983, by A. P. Murray, S. L. Weisberg, and L. F. Becker, Jr., titled "Decontamination of Metal Surfaces in Nuclear Power Reactors", now U.S. Pat. No. 4,587,043.

This application is related to application Ser. No. 513,567, filed July 14, 1983, by S. L. Weisberg, A. P. Murray and L. F. Becker, Jr., titled "Iron Removal From EDTA Solutions."

BACKGROUND OF THE INVENTION

The cooling systems of nuclear reactors tend to become coated with various radioactive deposits. While these deposits are not thick enough to plug the cooling systems, they do present a radiation hazard to personnel who must perform maintenance and repair work on them, Thus, it is necessary to remove the deposits in order to reduce the radioactivity to a level that is safe for personnel in the area. The deposits are conventionally removed by circulating through the cooling system a decontamination solution which solubilizes metal ions, and an oxidizing solution which oxidizes insoluble chromium oxides to the soluble dichromate ion. A typical decontamination solution consists of citric acid, oxalic acid, and a chelate, such as ethylenediaminetetraacetic acid (EDTA). A typical oxidizing solution consists of an alkali metal hydroxide and a permanganate.

Recently, it has been discovered (see U.S. Pat. No. 4,287,002) that ozone can be used as the oxidizer. Ozone offers several advantages over the alkali-permanganate in that it decomposes into oxygen and does not leave any ions remaining in the system, in addition to being an excellent oxidant. However, there are several disadvantages in using ozone as well, the principal one being its instability. This means that if the ozone must travel through a rather long cooling system, most of it will decompose before it reaches the end of the cooling system and the deposits in those portions of the cooling system will be insufficiently oxidized and will not be adequately removed.

SUMMARY OF THE INVENTION

We have discovered that the stability of an aqueous ozone oxidation solution for use in decontaminating the cooling systems of nuclear reactors can be greatly improved by the addition of a water-soluble cerium IV compound or a water-soluble aromatic compound having ketone groups on the aromatic ring, or both. Because the stability and solubility of the ozone are improved, the oxidizing power of the solution is not depleted in the remote reaches of the cooling system, and the oxidizing solution is more effective in removing the chromium from the deposits. This results in a high decontamination factor (i.e., the radioactivity before treatment divided by the radioactivity after treatment) during the subsequent decontamination solution treatment.

RELEVANT ART

U.S. Pat. No. 4,287,002 discloses the decontamination of the cooling systems of nuclear reactors using ozone instead of alkali permanganate. A deconoxidized-decon process is disclosed using ion exchange resins to remove ions from the solutions.

DESCRIPTION OF THE INVENTION

This invention applies to the cooling system of any nuclear reactor, including pressurized water reactors, boiling water reactors, and high temperature gas nuclear reactors. The invention can be used on the deposits in the entire cooling system of a reactor using the aqueous coolant that is already present, or a special aqueous solution can be made up which is then circulated through any portion of the cooling system, such as the steam generator.

The oxidizing solution used in this invention contains water, ozone, and either a water-soluble cerium IV compound or a water-soluble aromatic compound having ketone groups on the aromatic ring. Preferably, for maximum effectiveness, both the cerium IV compound and the aromatic compound are present. The ozone is dissolved in the water by sparging, which can produce a concentration of the ozone in the water from about $2\times10^{-4}\%$ (all percentages herein are by weight based on total solution weight) up to about saturation. No pH adjustment is necessary to the solution, but the pH will always be less than 7 because the components of the solution are acidic. The pH should not be permitted to rise to above 7 as that will result in the rapid decomposition of the ozone.

The water-soluble cerium IV compound can be any compound that is water soluble and in which cerium is in the +4 oxidation state. Examples of suitable compounds includes, ceric ammonium nitrate, ceric sulfate, ceric ammonium sulfate, and ceric sulfamate. The preferred compound is ceric ammonium nitrate because it is readily available, inexpensive, and very soluble in water. The cerium IV compound performs the function of oxidizing the chromium in the deposits in the cooling systems of the nuclear reactors, which reduces the cerium IV ion to a cerium III ion:

$$11H_2O + 6Ce^{+4} + Cr_2O_3 \rightarrow 2H_2CrO_4 + 6Ce^{+3} + 6H_3O^+$$

Because the cerium IV compound is more stable than the ozone, it oxidizes the chromium farther away from the point of injection of the ozone into the cooling system, and is itself reduced to cerium III. When the cerium III compound returns to the point of injection of the ozone, the ozone oxidizes it back to cerium IV, thus regenerating it:

$$6H_3O^+ + O_3 + 6Ce^{+3} \rightarrow 6Ce^{+4} + 9H_2O$$

About 0.01 to about 0.5% of the water-soluble cerium IV compound can be used in the solution. If less is used, the solution will be less effective as there will be insufficient cerium IV compound to couple with the ozone, and more is unnecessary, wasted, and gives rise to large waste volumes. The preferred amount is about 0.08 to about 0.12%.

The water-soluble romatic compound may be any aromatic compound that is water soluble and has at least one ketone group on an aromatic ring. Suitable aromatic compounds include naphthaquinone and quinone. Quinone is preferred as it readily forms an inclusion compound with ozone which increases the stability of the ozone and also increases it solubility. The amount of water-soluble aromatic compound in the solution can be between about 0.01 to about 0.5%. Less is ineffective and more is unnecessary and wasted. The preferred amount is about 0.05 to about 0.1.

If the process of this invention is to be applied to the cooling system of a power reactor with the aqueous coolant in place, the reactor should first be shut down, which results in a lowering of the temperature of the coolant to between about 60° and about 200° C. In order to obtain the most effective decontamination of the cooling system, it is preferable to use a decontamination solution followed by an oxidizing solution followed by a decontamination solution. Thus, the first step in the process would be the addition of a decontamination composition to the coolant. Suitable decontamination compositions are well known in the art and typically consist of a mixture of organic acids, such as citric acid and oxalic acid, with organic chelates such as ethylene diaminetetraacetic aicd. The coolant, containing the decontamination composition, is circulated between the cooling system where radioactive contaminating metal ions are dissolved and a cation exchange resin which removes the metal ions from the solution. The circulation is continued until the radioactivity in the coolant leaving the cooling system is not substantially greater than the radioactivity of the coolant entering the cooling system. The decontamination composition is then removed from the coolant by passing the coolant through an anion exchange resin.

The temperature of the coolant is then lowered to about 40° to about 100° C. Lower temperatures are difficult to achieve and higher temperatures will result in the decomposition of the ozone. The ozone, cerium IV compound, and/or the aromatic compound are then added to the coolant in amounts sufficient to give the concentrations specified. The coolant is then circulated until the chromium concentration in the coolant leaving the cooling system is not substantially greater than the chromium concentration in the coolant entering the cooling system.

The temperature of the coolant is then raised to over 100° C. in order to decompose the ozone. The coolant is passed through an ion exchange resin which contains an anion resin, such as an anion exchange resin or mixed anion/cation exchange resin, in order to remove the anions in the solution. The temperature of the coolant is then adjusted to between about 60° and about 200° C. and the decontamination composition is again added and circulated through a cation exchange resin until the radioactivity level stabilizes. The decontamination composition is then removed from the coolant by passing the coolant through an anion exchange resin. This completes the decontamination of the cooling system.

If a portion of the cooling system, such as the steam generator, is to be decontaminated, it is drained and the decontamination solution and oxidizing solutions are made up in tanks and are passed through that portion of the cooling system with water rinses in between. Otherwise, the procedure is identical.

We claim:

1. A composition having a pH less than 7 comprising:

(A) water;

(B) dissolved ozone; and (C) about 0.01 to about 0.5% of at least one water-soluble aromatic compound having at least one ketone group on an aromatic ring.

2. A composition according to claim 1 wherein said aromatic compound is quinone.

3. A composition according to claim 1 wherein said water-soluble aromatic compound is selected from the group consisting of quinone, naphthaquinone, and mixtures thereof.

4. A method of oxidizing chromium in deposits in the cooling system of a nuclear reactor comprising (A) circulating through said cooling system a solution having a pH less than 7 which comprises (1) water;

(2) dissolved ozone; and (3) about 0.01 to about 0.5% of a water soluble aromatic compound selected from the group consisting of quinone, naphthaquinone, and mixtures thereof; then (B) injecting ozone into said solution as it circulates through said cooling system.

5. A process according to claim 4, wherein said aromatic compound is quinone.

6. A process according to claim 4 wherein said solution comprises the aqueous coolant of said nuclear reactor.

7. A process according to claim 4 wherein said solution containing said compound is made up and passed through said cooling system.

8. A process according to claim 2 wherein said cooling system is in the steam generator of a pressurized water reactor.

9. A process for decontaminating the cooling system of a nuclear reactor comprising:

(A) shutting down said reactor;

(B) adding a decontamination composition to the coolant in said cooling system;

(C) circulating said coolant between a cation exchange resin and said cooling system until the radioactivity in said coolant leaving said cooling system is not substantially greater than the radioactivity of said coolant entering said cooling system;

(D) removing said decontamination composition from said coolant by passing said coolant through an anion exchange resin;

(E) adjusting the temperature of said coolant to about 40° to about 100° C.;

(F) adding compounds to said coolant so that said coolant comprises a composition containing water, dissolved zone and 0.01 to 0.5% of at least one water-soluble aromatic compound having at least one ketone group on an aromatic ring;

(G) circulating said coolant in said cooling system until the chromium concentration no longer increases substantially;

(H) raising the temperature of said coolant to at least about 100° C.;

(I) passing said coolant through an ion exchange resin containing an anion resin;

(J) adjusting the temperature of said coolant to about 60° to about 200° C.; and then (K) repeating steps (B), (C), and (D).

10. A process according to claim 9 wherein said decontamination composition is an organic acid and a chelate.

11. A method of oxidizing chromium in deposits in the cooling system of a nuclear reactor comprising (A) circulating through said cooling system a solution having a pH less than 7 which comprises
(1) water;
(2) dissolved ozone;
(3) about 0.01 to about 0.5% of at least one water-soluble aromatic compound having at least one ketone group on an aromatic ring; and (B) injecting ozone into said solution as it circulates through said cooling system.

12. A method according to claim 11 wherein said water-soluble aromatic compound is selected from the group consisting of quinone, naphthaquinone, and mixtures thereof.

* * * * *